US010400639B2

(12) United States Patent
Pham

(10) Patent No.: US 10,400,639 B2
(45) Date of Patent: Sep. 3, 2019

(54) VARIABLE VALVE TRAIN WITH A ROCKER ARM

(71) Applicant: MAN Truck & Bus AG, München (DE)

(72) Inventor: Hai-Son Pham, Nürnberg (DE)

(73) Assignee: MAN TRUCK & BUS AG, Munich (DE)

( * ) Notice: Subject to any disclaimer, the term of this patent is extended or adjusted under 35 U.S.C. 154(b) by 0 days.

(21) Appl. No.: 15/355,573

(22) Filed: Nov. 18, 2016

(65) Prior Publication Data

US 2017/0145876 A1 May 25, 2017

(30) Foreign Application Priority Data

Nov. 20, 2015 (DE) ..... 10 2015 015 087

(51) Int. Cl.
*F01L 13/00* (2006.01)
*F01L 1/18* (2006.01)
(Continued)

(52) U.S. Cl.
CPC ..... *F01L 13/0036* (2013.01); *F01L 1/047* (2013.01); *F01L 1/181* (2013.01); *F01L 1/267* (2013.01);
(Continued)

(58) Field of Classification Search
CPC ..... F01L 1/181; F01L 2001/186; F01L 1/267; F01L 1/46; F01L 2001/467; F01L 13/0036; F01L 2105/00
(Continued)

(56) References Cited

U.S. PATENT DOCUMENTS 4,726,332 A 2/1988 Nishimura et al.
5,080,054 A 1/1992 Nakamura
(Continued)

FOREIGN PATENT DOCUMENTS

DE 3613945 A1 10/1986
DE 4142197 A1 4/1993
(Continued)

OTHER PUBLICATIONS

European Search Report issued in corresponding application No. 16002314.9 dated Feb. 2, 2017.
(Continued)

*Primary Examiner* — Jorge L Leon, Jr.
(74) *Attorney, Agent, or Firm* — Weber Rosselli & Cannon LLP

(57) ABSTRACT

A variable valve train for a gas exchange lifting valve of an internal combustion engine. The valve can be moved between open and closed positions periodically by way of a cam via a rocker arm. The variable valve train includes a camshaft having at least first and second cams which are arranged offset in the longitudinal direction of the camshaft. The first and second cams having cam contours. The valve train includes a rocker arm mounted which pivots about a rocker arm axis and is assigned to the at least one first cam via a pressure roller at its camshaft-side end and is connected to at least one lifting valve at its valve-side end, and a roller lever which is assigned to the at least one second cam at its camshaft-side end and is articulated at its other end on the rocker arm and pivots about the rocker arm axis.

14 Claims, 5 Drawing Sheets

(51) Int. Cl.
*F01L 1/26* (2006.01)
*F01L 1/047* (2006.01)
*F02D 13/02* (2006.01)

(52) U.S. Cl.
CPC .... *F02D 13/0207* (2013.01); *F01L 2001/186* (2013.01); *F01L 2105/00* (2013.01); *F01L 2105/02* (2013.01); *F01L 2820/033* (2013.01)

(58) Field of Classification Search
USPC ..... 123/90.16, 90.39, 90.44
See application file for complete search history.

(56) References Cited

U.S. PATENT DOCUMENTS

| | | | | |
|---|---|---|---|---|
| 7,311,073 | B1 | 12/2007 | Kim et al. | |
| 2004/0107927 | A1* | 6/2004 | Sellnau | F01L 1/08 123/90.16 |
| 2005/0247279 | A1 | 11/2005 | Rorig et al. | |
| 2007/0039578 | A1* | 2/2007 | Evans | F01L 1/08 123/90.16 |
| 2007/0266973 | A1* | 11/2007 | Lancefield | F01L 1/146 123/90.16 |
| 2009/0178637 | A1* | 7/2009 | Gecim | F01L 1/181 123/90.39 |
| 2011/0226207 | A1* | 9/2011 | Riley | F01L 1/185 123/90.39 |
| 2013/0239919 | A1 | 9/2013 | Manther | |
| 2017/0198610 | A1* | 7/2017 | Haefner | F01L 1/205 |

FOREIGN PATENT DOCUMENTS

| | | | |
|---|---|---|---|
| DE | 4230877 | A1 | 4/1993 |
| DE | 4412851 | A1 | 5/1995 |
| DE | 19519048 | A1 | 11/1996 |
| DE | 19520117 | A1 | 12/1996 |
| EP | 1149988 | A2 | 10/2001 |
| JP | 2006132378 | A | 5/2006 |
| WO | 2004/033862 | A1 | 4/2004 |
| WO | 2004033862 | A1 | 4/2004 |

OTHER PUBLICATIONS

European Office Action issued in corresponding EP Application No. 16002314.9 dated Nov. 30, 2018, 3 pages, English translation not available.

* cited by examiner

A – A

VARIABLE VALVE TRAIN WITH A ROCKER ARM

DESCRIPTION OF RELATED ART

The present disclosure relates to a variable valve train for a lifting valve, in particular for a gas exchange valve of an internal combustion engine, which valve can be moved periodically indirectly by way of a cam via a rocker arm between a closed and an open position.

It is known to operate gas exchange valves of an internal combustion engine in a variable manner with different opening and closing times and with different valve opening lifts. Variable valve trains of this type afford the advantageous possibility of targeted adaptation of the profile of the valve lift curve against the cam angle as a function of operating parameters of the device which is equipped with the respective lifting valve, that is to say, for example, as a function of rotational speed, load or temperature of an internal combustion engine.

It is known, in particular, to produce a plurality of different lifting curves for a lifting valve by virtue of the fact that a plurality of cams are present for actuating said lifting valve, and that in each case the contour of only one cam brings about the lifting profile. In order to switch over to another lifting profile, a switchover is made to the contour of another cam. A valve controlling means of this type is known previously from DE 42 30 877 A1. Here, a camshaft block with two different cam contours is arranged on a camshaft fixedly so as to rotate with it, but in an axially displaceable manner. In accordance with the axial position of the cam block, one cam contour is operatively connected via an intermediate member (transmission lever) to the lifting valve. The axial displacement of the cam block for changing the valve parameters takes place during the base circle phase by means of a pressure ring counter to the action of a restoring spring.

A variable valve train for an internal combustion engine is previously known from DE 195 19 048 A1, in which variable valve train two cams with cam contours of different design are likewise arranged immediately next to one another on the camshaft. The change in the cam engagement takes place by way of an axial displacement of the camshaft with the cams which are situated on it.

Furthermore, a valve train of an internal combustion engine is previously known from DE 195 20 117 C2, in which an axially displaceable cam block with at least two different cam tracks is arranged fixedly on the camshaft so as to rotate with it. The adjustment of the cam block takes place via an adjusting member which is guided in the interior of the camshaft. The adjusting member is displaced in the interior of the camshaft by way of a double-acting hydraulic or pneumatic piston/cylinder unit which is arranged on the end side of the camshaft. The adjusting member is connected to a driving piece which penetrates a slot which is arranged axially in the camshaft and opens into a bore of the cam block.

A disadvantage in the cited prior art is the high installation space requirement which is required to adjust the cam block and/or to axially adjust the camshaft.

Furthermore, DE 41 42 197 A1 has disclosed a rocker arm arrangement for a variable valve train, a first rocker arm of each rocker arm pair being assigned to a cam with a small cam lift and a second rocker arm being assigned to a cam with a large cam lift, furthermore having in each case one locking device for each rocker arm pair, by way of which locking device only the cam which has the larger cam lift becomes active for both rocker arms when said locking device is switched on. A disadvantage of said known valve train is the necessity for an external spring stop, in order to ensure the restoring action of the second rocker arm. This and the independent mounting of the second rocker arm additionally do not make any pre-assembly possible. The two levers likewise require one driving point, which leads to it being necessary for the two cam profiles to be symmetrical with respect to one another and/or the peak of the two cams not to have any angular offset with respect to one another. This prevents the possibility of varying the phase position of the valve lifts.

SUMMARY

It is therefore an object of the present disclosure to provide an improved variable valve train with a rocker arm, by way of which disadvantages of conventional technologies can be avoided. The present disclosure is based, in particular, on the object of a structurally compact design which is simple to assemble of a variable valve train of this type.

These objects are achieved by way of a variable valve train having the features of the independent claim. Advantageous embodiments and applications of the present disclosure are the subject matter of the dependent claims and will be explained in greater detail in the following description with partial reference to the figures.

According to the present disclosure, a variable valve train for a lifting valve is provided. The lifting valve can be moved periodically indirectly by way of a cam of a camshaft via a rocker arm between a closed and an open position, in particular counter to the force of a restoring spring. The lifting valve may be a gas exchange valve of an internal combustion engine.

According to general aspects of the present disclosure, the valve train comprises a camshaft, having at least one first cam and at least one second cam which is arranged offset in the longitudinal direction of the camshaft, the at least one first cam and the at least one second cam being of different design in terms of their cam contour. For example, the cam contour of the at least one first cam can have a different cam elevation and/or a different phase position with respect to the cam contour of the at least one second cam. The at least one second cam may have a greater cam elevation (cam lift) than the at least one first cam.

In each case taking the valve play into consideration, the cam contours determine the opening and closing point and/or the opening lift of the lifting valve in accordance with their configurations. A second cam can be arranged immediately adjacently with respect to a first cam.

Furthermore, the valve train comprises a rocker arm which is mounted such that it can be pivoted about a rocker arm axis, which rocker arm is assigned to the first cam via a roller, in particular a pressure roller, at its camshaft-side end and is operatively connected to the lifting valve at its valve-side end. Therefore, one arm of the rocker arm serves to actuate the lifting valve, and the other lever arm is driven by way of a cam. The rocker arm is can be mounted in a central region on the rocker arm axis.

Furthermore, the valve train comprises a roller lever which is assigned to the at least one second cam via at least one roller at its camshaft-side end, that is to say it follows the movement of the second cam/cams, and is articulated at its other end on the rocker arm such that it can be pivoted about the rocker arm axis.

Furthermore, the valve train comprises a switchable hydraulic locking device, by way of which the rocker arm and the roller lever can optionally be locked rigidly to one another, the rocker arm and the roller lever following the movement of the at least one second cam, or being able to be unlocked from one another, the rocker arm and the roller lever being rotatable independently of one another and both following the respectively associated cam independently of one another. In the unlocked state, the second cam is inactive; although it actuates the roller lever, the latter performs only tilting movements, without an influence on the valve. In the state in which they are locked by way of the locking device, in contrast, the rocker arm and the roller lever are connected to one another fixedly so as to rotate together, with the result that both can be pivoted only jointly about the rocker arm axis.

One particular advantage of the valve train according to the present disclosure lies in the compact design which does not influence, or at least scarcely influences, the height and length of the installation space of a conventional rocker arm-based valve train. The rocker arm becomes merely wider, but is within the order of magnitude of a conventional two-valve rocker arm. By virtue of the fact that the roller lever is fastened pivotably directly to the rocker arm, the rocker arm arrangement comprising rocker arm and roller lever can be used as one unit in a pre-assembled manner, as a result of which the assembly complexity can be reduced. The present disclosure likewise makes it possible to retrofit an existing valve train without variability, without in the process requiring modifications to surrounding components, apart from those which are required directly for the realization of the variability. A further advantage lies, in particular, in the fact that no modifications to the cylinder head are necessary if a conventional non-variable rocker arm valve train is to be replaced by way of the variable valve train according to the present disclosure.

According to one embodiment, in each case one second cam, that is to say a cam with a different cam contour from the middle first cam, is provided on both sides of the first cam as viewed in the longitudinal direction of the camshaft. Accordingly, the roller lever is configured in such a way that it has two arms which extend on both sides from the camshaft-side end of the rocker arm and follow the cam contour of the two second cams. The two arms follow the second cam which is assigned to them in each case by way of a roller, for example a pressure roller, which rolls on the second cam. This two-arm embodiment of the roller lever makes an advantageous force flow possible, in order to transmit the cam movement of the second cams via the roller lever to the rocker arm and via the rocker arm to the lifting valve in the switched-on state of the hydraulic locking device.

According to one alternative embodiment, in each case one first cam can be provided on both sides of the second cam, and the camshaft-side end of the rocker arm can extend on both sides from the roller lever and follow the cam contour of the two first cams. In this alternative embodiment, the camshaft-side end of the rocker arm therefore has two arms, the roller lever being arranged in between. The two arms follow the first cam which is assigned to them in each case by way of a roller, for example a pressure roller, which rolls on the first cam.

According to a further embodiment, the roller lever is connected to the rocker arm via a hinge, in order to fasten the roller lever to the rocker arm such that it can be rotated about the rocker arm axis. For example, the rocker arm and the roller lever can in each case have a pivot pin seat, which pivot pin seats are arranged aligned with respect to one another and have an inserted pivot pin.

A further advantageous possibility of the realization according to the present disclosure provides that the rocker arm and the roller lever are braced against one another via at least one restoring spring in such a way that the rollers of the roller lever and the rocker arm are aligned with respect to one another in a base circle position. In other words, the roller lever is pressed permanently onto the main rocker arm by way of the restoring spring, while the camshaft is situated in a base circle position.

Here, said restoring springs may press onto a bearing point on or of the rocker arm and onto a bearing point on or of the roller lever. Easy pre-assembly of the entire switchable rocker arm is possible by way of the mutual bracing.

It is particularly advantageous if two restoring springs of this type are arranged on both sides of the rocker arm as viewed in the longitudinal direction of the rocker arm axis.

According to one embodiment, the switchable hydraulic locking device comprises a hydraulically actuable switching pin which can be moved from a first position (release position) into a second position (locked position) by way of loading with a predefined hydraulic pressure. In the second position, the switching pin prevents a relative movement of the rocker arm with respect to the roller lever about the rocker arm axis, that is to say the roller lever can no longer be pivoted about the rocker axis independently of the rocker arm in the second position. In the first position, the switching pin permits a relative movement of the rocker arm and the roller lever with respect to one another. In the second position, the rocker arm and the roller lever are locked hydraulically, but in contrast they are not locked hydraulically in the first position.

According to one advantageous variant of said embodiment, a guide pin, a pin spring which is plugged onto the guide pin, and the switching pin of the hydraulic locking device which is screwed to the guide pin are arranged in the rocker arm in a sliding guide bore of the rocker arm. The switching pin can be loaded with a predefined oil pressure via a pressure chamber which can be filled with oil in order to actuate the switching means.

Here, the locking device can be configured according to a first variant in such a way that the switching pin, in a state in which it is not loaded with the predefined pressure, is held by way of the pin spring which acts as a restoring spring and the guide pin in the first position, and, in a state in which it is loaded with the predefined pressure, is pressed into the second position, in which the switching pin protrudes out of the rocker arm in the direction of the roller lever and moves into an aligned sliding guide seat of the roller lever.

Here, furthermore, the locking device can be configured according to a second variant in such a way that the switching pin, in a state in which it is not loaded with the predefined pressure, is held in the second position (locked position) by way of the pin spring, with the result that the roller lever and the rocker arm are locked to one another fixedly so as to rotate together, and, in a state in which they are loaded with the predefined pressure, are pressed into the first position, in which the switching pin is lowered into the rocker arm and unlocks the two levers from one another.

The sliding guide seat of the roller lever is of open design, with the result that the air which is compressed by way of the switching pin moving out can escape and does not exert any resistance on the extending movement of the switching pin. This opening is already provided in the blank part of the roller lever, with the result that no additional ventilating bore is required.

The rocker arm can have a geometry for axial fixing on a bearing block on its underside, that is to say the side which faces the cylinder head. For example, the rocker arm can have a bearing for fastening to a rocker arm bearing block, on which the rocker arm axis is arranged, onto which the rocker arm is plugged pivotably by way of an associated bore and is held by means of an axial positional securing means, the axial positional securing means being a guide connection as engagement element/counterelement connection between the bearing block and the rocker arm, in which an engagement element, for example in the form of an annular web, which is oriented transversely with respect to the axial direction engages into an associated counterelement with axial flank support in a pivotably movable manner.

A further aspect of the present disclosure relates to a motor vehicle, in particular a commercial vehicle, having a variable valve train, as described in this document.

The above-described embodiments and features of the present disclosure can be combined with one another in any desired manner.

BRIEF DESCRIPTION OF THE DRAWINGS

Further details and advantages of the present disclosure will be described in the following text with reference to the appended drawings, in which.

DETAILED DESCRIPTION

Figure 1:
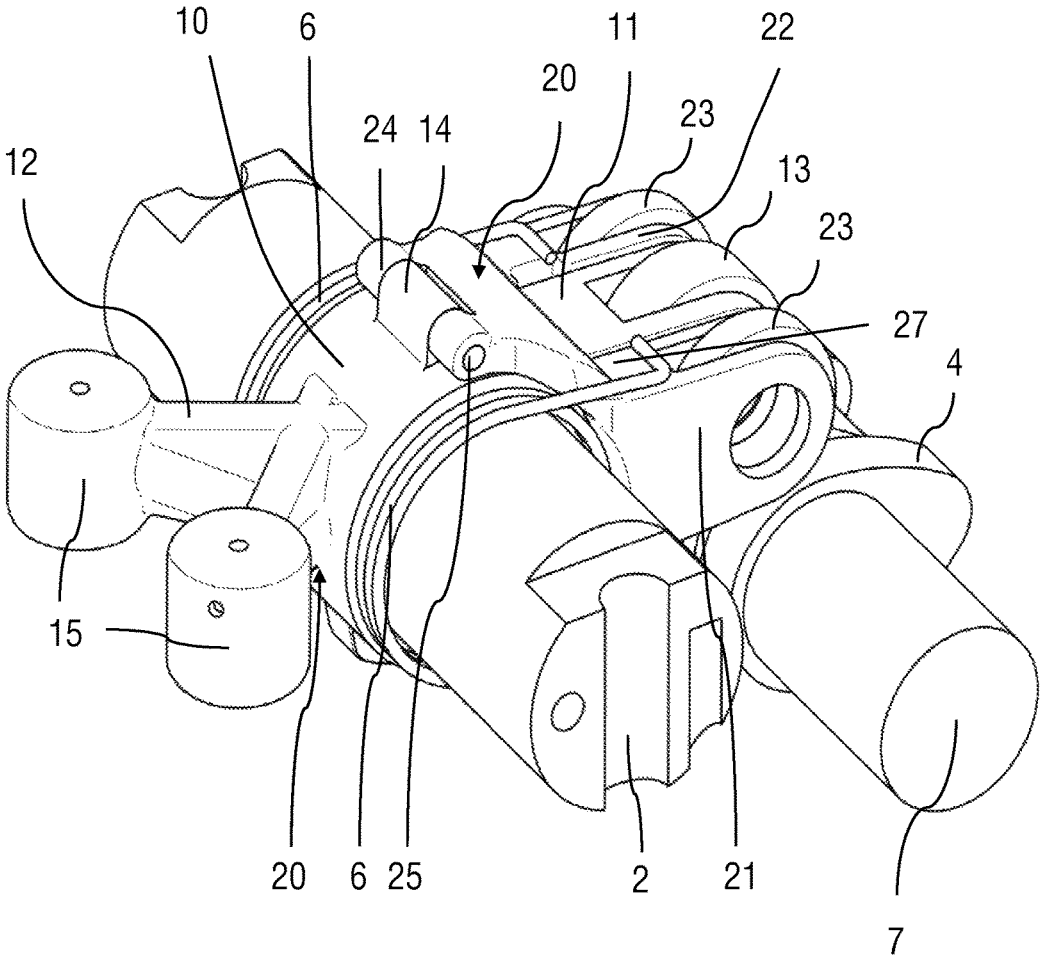
FIG. 1 shows a perspective front view of a valve train according to one embodiment of the present disclosure.

Identical parts are provided with the same reference numerals in the figures, with the result that the various views of the valve train which are shown in the figures are also comprehensible in themselves.

Figure 2:
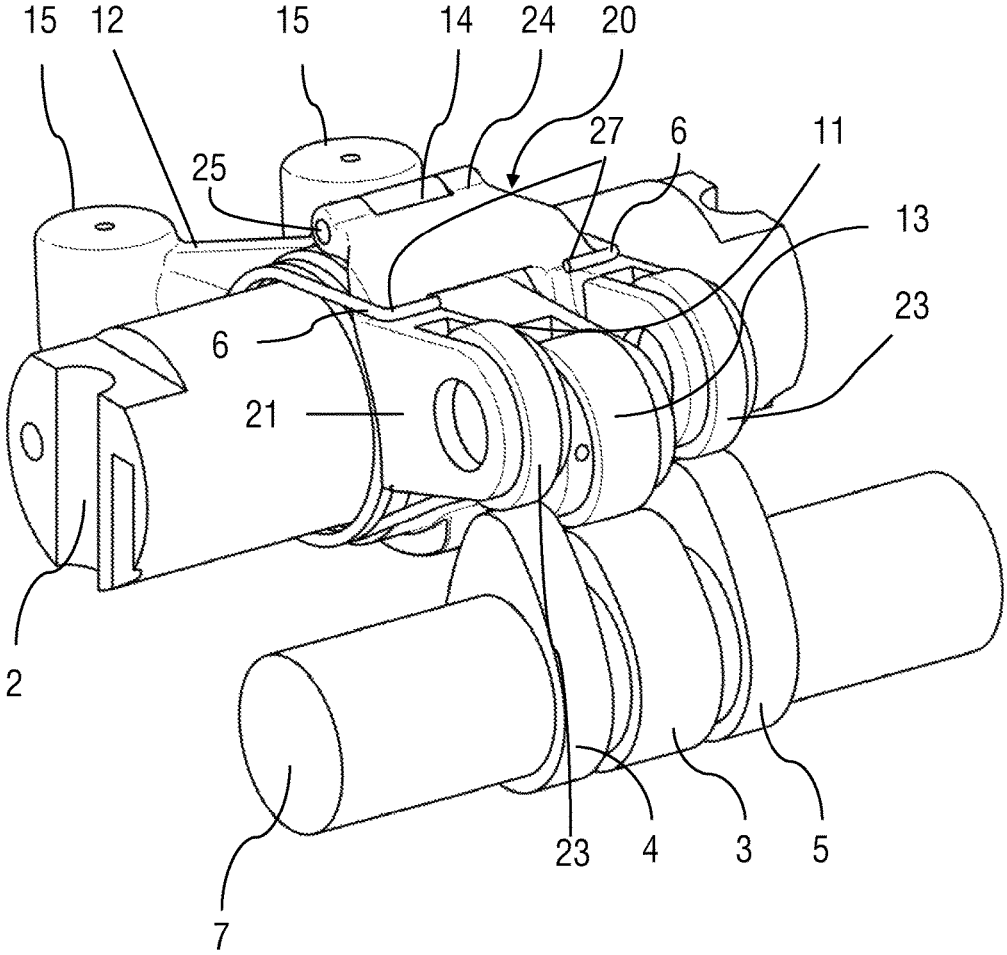
FIG. 2 shows a perspective side view of a valve train according to one embodiment of the present disclosure.
Figure 3:
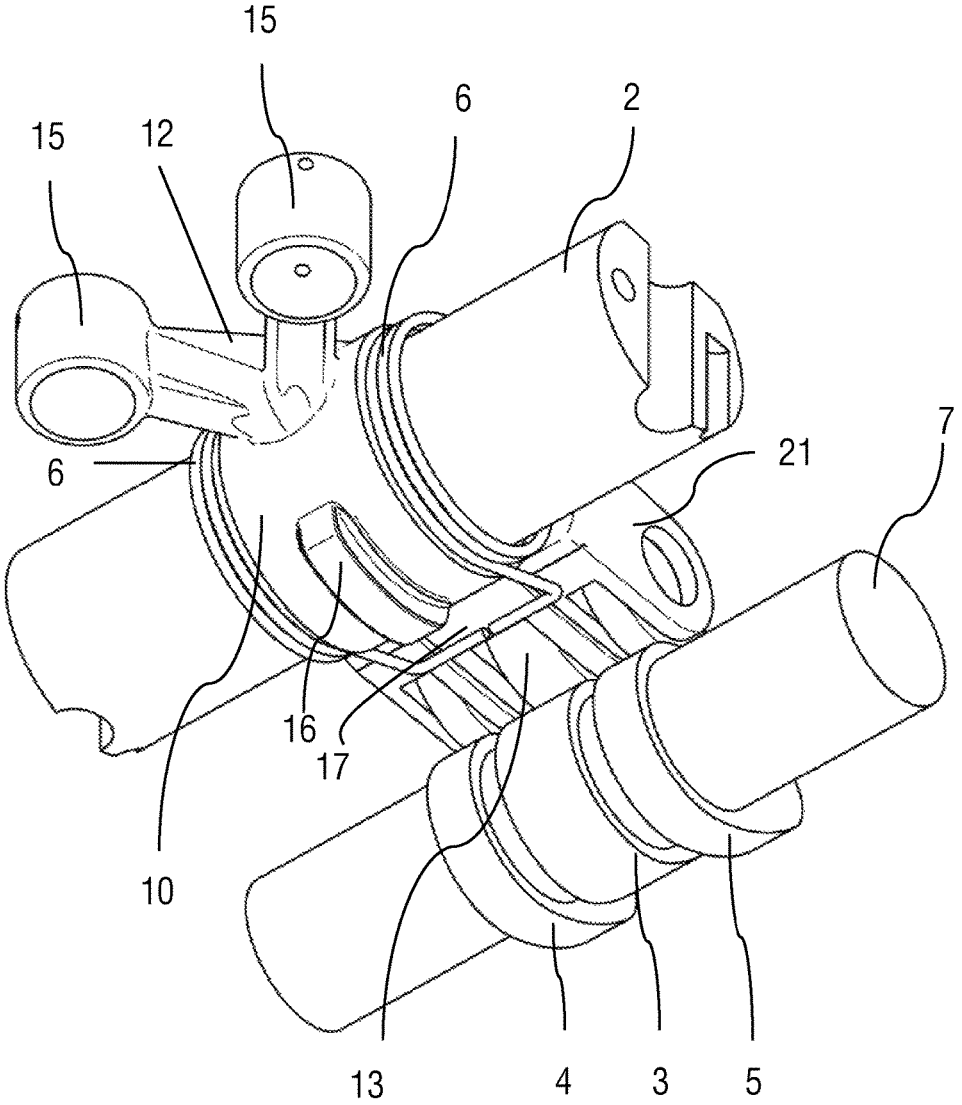
FIG. 3 shows a perspective view from below of a valve train according to one embodiment of the present disclosure.

FIGS. 1 to 3 show different perspective views of a variable valve train 1 according to one embodiment of the present disclosure. The valve train 1 serves to actuate a gas exchange valve (not shown) of an internal combustion engine, which gas exchange valve can be moved periodically indirectly by way of a cam via a rocker arm between a closed and an open position.

The camshaft 7 has a middle cam 3, also called a first cam in this document, and two further cams 4, 5 which are arranged offset as viewed in the longitudinal direction of the camshaft 7. Said cams 4, 5 are also in each case called second cams in this document. The two cams 4, 5 are arranged on both sides of the middle cam and adjacently with respect to the latter. The middle cam 3 and the two second cams 4, 5 are of different design in terms of their cam contour. The second cams 4, 5 have a greater cam lift than the middle cam 3.

Furthermore, the phase position of the middle cam 3 can differ from the second cams 4, 5. Depending on the application, the first cam can also be configured as a zero cam, with the result that the valves remain closed.

Of the two cam contours, only one is always relevant for the valve movement in a switching state, which will be explained in the following text.

Furthermore, the valve train comprises a rocker arm arrangement, having a rocker arm 10 which is mounted such that it can be pivoted about a rocker arm axis 2 and is assigned to the first cam 3 via a pressure roller 13 at its camshaft-side end 11, in order to follow said first cam 3, and is operatively connected to at least one lifting valve at its valve-side end 12.

The rocker arm 10 is secured on a rocker arm bearing block (not shown), the rocker arm axis 2 being arranged on the rocker arm bearing block, onto which rocker arm axis 2 the rocker arm 10 is plugged pivotably by way of an associated bore and is held by means of an axial positional securing means.

The axial positional securing can take place, for example, in a manner known per se via bearing faces on the rocker arm flanks. Said flanks can be produced, for example, by calibration of the cast blank or by machining. On the bearing block side, the fixing can likewise take place via correspondingly machined surfaces and by means of washers and securing rings. Furthermore, axial positional securing means between a rocker arm and the axis are known. For example, a region of the axis which is enclosed by the bore of the rocker arm has an annular groove for this purpose, in which annular groove a circlip runs which at the same time runs with its outer annular section in an annular groove of the rocker arm.

In the present exemplary embodiment, the axial positional securing means is configured as an engagement element/counterelement connection between the bearing block and the rocker arm, in which connection an engagement element which is oriented transversely with respect to the axial direction, for example in the form of an annular web 16, engages into an associated counterelement (not shown) with axial flank support in a pivotably movable manner.

The valve-side lever arm 12 of the rocker arm 10 is configured as a two-valve lever arm, in order to actuate two gas exchange valves at the same time. To this end, the valve-side lever arm 12 is of fork-shaped configuration. A seat 15 is arranged at each valve-side end of the lever arm 12. The seat 15 can be used for mounting a hydraulic valve play compensating element (not shown) which is known per se. Instead of a hydraulic valve play compensating element, a screw with an elephant foot can also be received in the seat 15, by means of which screw a valve play can be readjusted manually.

Hydraulic valve play compensating elements in internal combustion engines are known per se and serve, in particular, to compensate for the length dimensions of the gas exchange valves which change over the service life, in such a way that reliable valve closure is ensured in the base circle phase of the cam which actuates the valve. Here, the cam elevation is secondly to be transmitted to the valve without losses and thus to be converted into a valve lift movement. The method of operation of hydraulic valve play compensating elements of this type which are arranged in the force flow of a valve control means, in particular of an internal combustion engine, is assumed to be known.

In order to configure a variable valve train, furthermore, the valve train 1 comprises a roller lever 20 which is assigned at its camshaft-side end 21 to the two second cams 4, 5 and is articulated at its other end on the rocker arm 10 such that it can be pivoted about the rocker arm axis 2.

The rocker arm 10 is connected rotatably to the roller lever 20 via a pivot pin 25. A pivot pin seat 14 is situated on the rocker arm 10 and a pivot pin seat 24 is situated on the roller lever 20 for said connection. The pivot pin seats 14, 24 which are aligned with one another are arranged on an upper side of the rocker arm 10, that is to say a side which faces away from the cylinder head, to be precise in a middle region of the rocker arm 10 which forms the cylindrical recess of the rocker arm, in which the rocker arm axis 2 is received.

The camshaft-side lever arm 11 of the rocker arm 10 guides a pressure roller 13 at its end, which pressure roller 13 is assigned to the middle cam 3, in order to follow the cam 3 or its rotational movement.

The roller lever has two parallel arms 21 which extend towards the camshaft and also in each case extend on different sides from the camshaft-side lever arm 11 of the rocker arm 10 as viewed in the longitudinal direction of the camshaft.

Each of the two arms 21 likewise guides a pressure roller 23 at the end. Each of the pressure rollers 23 is assigned to one of the two second cams 4, 5, in order to follow the latter.

Both the rocker arm 10 and the roller lever 20 are therefore mounted rotatably with respect to the rocker arm axis 2 and can be pivoted with respect to the rocker arm axis independently of one another, at least when the rocker arm 10 and the roller lever 20 are not locked to one another by way of the switchable hydraulic locking device.

Furthermore, the rocker arm 10 and the roller lever 20 are braced against one another via two restoring springs 6 which are fastened on both sides, with the result that the roller lever 20 is pressed permanently onto the rocker arm 10 while the camshaft is situated in a base circle position. Here, a base circle phase or cam base circle phase is to be understood, in particular, to mean an angular range of the cam unit, in which cam contours of all part cams of the cam unit assume a common base circle level.

Said restoring springs 6 press onto the bearing point 17 of the rocker arm 10 (see FIG. 3) and also against the bearing point 27 of the roller lever 20 (see FIG. 1 or 2). Pre-assembly of the entire switchable rocker arm arrangement 10, 20 is possible as a result of the mutual bracing.

Furthermore, the variable valve train 1 comprises a switchable hydraulic locking device or a hydraulic switching element 30, by way of which the rocker arm 10 and the roller lever 20 are locked rigidly to one another when said switching element 30 is switched on, and both follow the movement of the second cams 4, 5.

Figure 4:
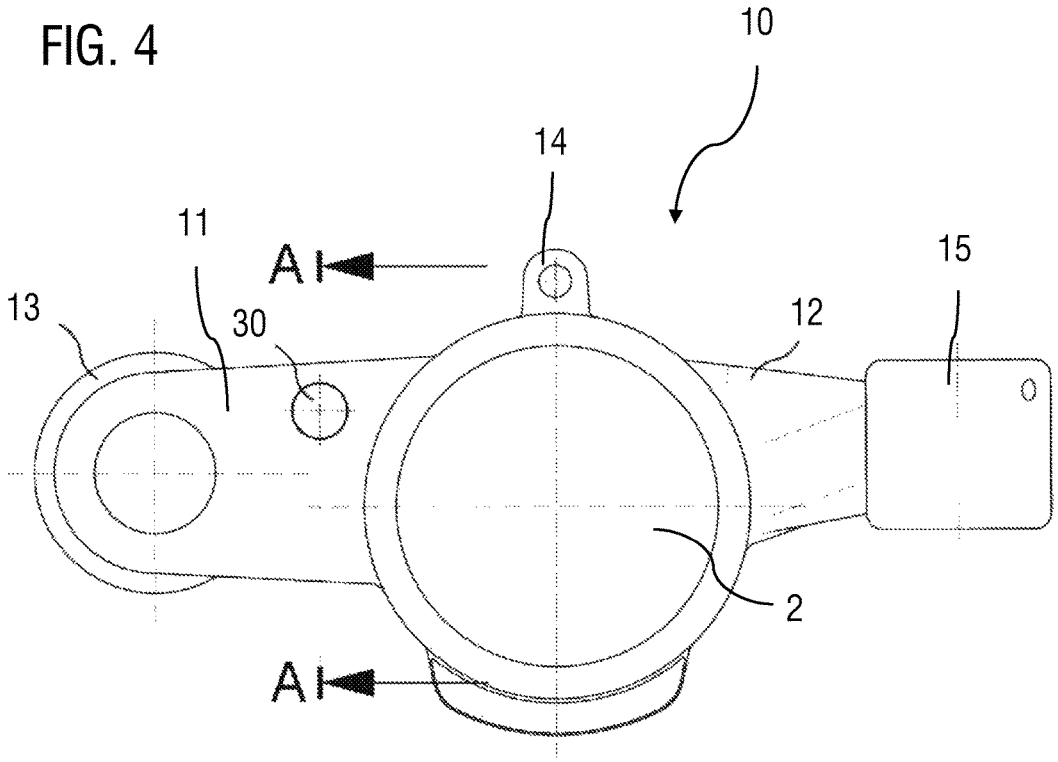
FIG. 4 shows a side view of a rocker arm according to one embodiment of the present disclosure.
Figure 5:
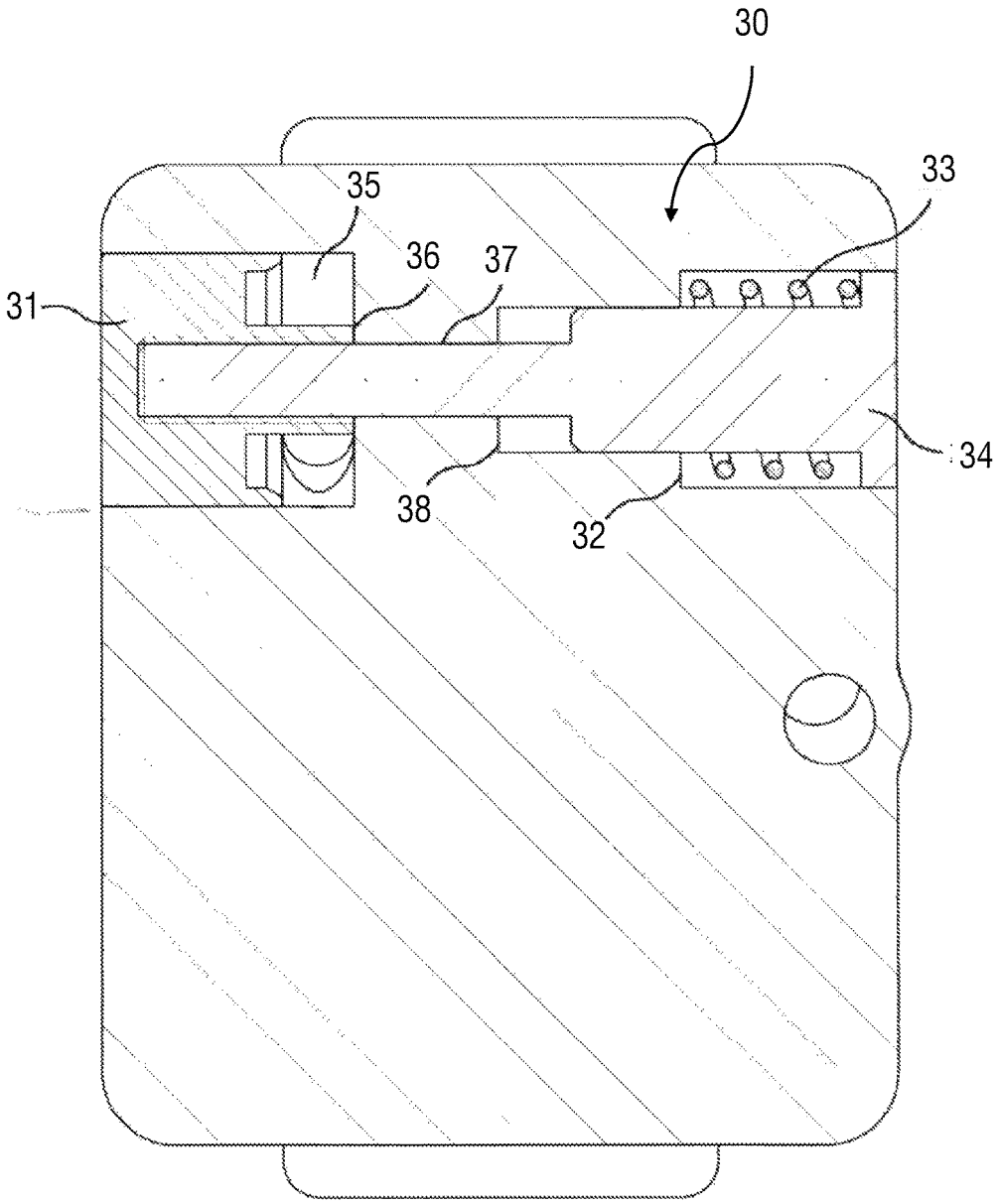
FIG. 5 shows a section A-A through FIG. 4.

To this end, the switchable hydraulic locking device 30, the construction of which will be explained in greater detail using FIGS. 4 and 5, is situated in the rocker arm 10.

The switchable hydraulic locking device 30 comprises a guide pin 34, onto which a pin spring 33 is plugged. The guide pin 34 and the pin spring 33 are situated in a sliding guide bore 37 which is made in the camshaft-side lever arm 11 of the rocker arm 10. The guide pin 34 is screwed in the sliding guide bore 37 with a switching pin 31. The pin spring 33 comes into contact with a spring stop 32. Moreover, the switching pin 31 has a zero point rest 36. In a basic state (no pressure loading), the switching pin 31 is pressed by the pin spring 33 onto the zero point rest 36. A pressure chamber 35 which is filled with oil in order to actuate the switching means is situated behind the switching pin 31. The switching pin 31 is pressed out with the screwed guide pin 34 by way of the oil pressure in the pressure chamber 35, with the result that the pin spring 33 is compressed. Here, the guide pin 34 comes into contact with the bearing face 38, with the result that there is a defined end position in the extended state of the two pins 31, 34.

In said extended state of the switching pin 31, the latter protrudes out of the rocker lever arm 11, in the direction of an adjacent arm 21 of the roller lever 10, and engages into a sliding guide seat (not shown) of the roller lever 10, which sliding guide seat is provided in an aligned manner. As a result, the switching pin 31 locks the rocker arm 10 to the roller lever in the extended state. In said state, the rocker arm 10 and the roller lever 20 can no longer be pivoted about the rocker arm axis 2 independently of one another, but rather only jointly. In said locked state, the rocker arm 10 and the roller lever 20 follow the cam contour of the second cams 4, 5, since the latter have the greater lift.

If the oil pressure diminishes, the switching pin 31 including the guide pin 34 is pressed against the zero point rest 36 again by way of the spring force of the pin spring 33, and the roller lever 20 is decoupled again from the rocker arm 10.

The rocker arm 10 and the roller lever 20 are therefore mounted such that they can be rotated about the rocker arm axis 2 independently of one another when the hydraulic locking device 30 is not switched on, with the result that the second cams 4, 5 are inactive, that is to say, although the second cams 4, 5 actuate the roller lever 20, it performs only tilting movements, without influence on the valve. In contrast, the rocker arm and the roller lever are connected to one another fixedly so as to rotate together when the locking device is switched on, with the result that both can be pivoted about the rocker arm axis 2 only jointly.

By way of selective loading of the pressure chamber 35 with a hydraulic pressure, a switchover can therefore be made at a desired time, for example as a function of operating parameters, from the first cam contour of the middle cam 3 to an alternative cam contour of the second cams 4, 5 or vice versa, in order to operate the gas exchange valves of the internal combustion engine in a variable manner with different opening and closing times and/or with different valve opening lifts.

Although the present disclosure has been described with reference to defined exemplary embodiments, a person skilled in the art can see that various amendments can be carried out and equivalents can be used as a replacement, without departing from the scope of the present disclosure. In addition, many modifications can be performed, without departing from the associated scope. As a consequence, the present disclosure is not to be restricted to the disclosed exemplary embodiments, but rather is to comprise all exemplary embodiments which fall within the scope of the appended patent claims. In particular, the present disclosure also claims protection for the subject matter and the features of the subclaims independently of the claims which are referred to.

LIST OF REFERENCE NUMERALS

1 Valve train
2 Rocker arm axis
3 First cam, for example middle cam
4, 5 Second cam
6 Restoring spring
7 Camshaft
10 Rocker arm
11 Camshaft-side lever arm
12 Valve-side lever arm
13, 23 Pressure roller
14, 24 Pivot pin seat
15 Seat
16 Annular web
17, 27 Bearing point for restoring spring
20 Roller lever
21, 22 Lever arm
23 Bearing point for restoring spring
25 Pivot pin
30 Hydraulic locking device

31 Switching pin
32 Spring stop
33 Pin spring
34 Guide pin
35 Pressure chamber
36 Zero point rest
37 Sliding guide bore
38 Bearing face

The invention claimed is:

1. A variable valve train for a lifting valve, which valve is moved periodically indirectly by way of a cam via a rocker arm between a closed and an open position, the valve train comprising:

(a) a camshaft, having at least one first cam and at least one second cam which are arranged offset in a longitudinal direction of the camshaft, the at least one first cam and the at least one second cam having different cam contours;

(b) a rocker arm, having a camshaft-side end and a valve-side end, and mounted pivotally about a rocker arm axis, the rocker arm is assigned to the at least one first cam via a roller on the camshaft-side end and is operatively connected to at least one lifting valve on the valve-side end;

(c) a roller lever assigned to the at least one second cam via at least one roller on a camshaft-side end of the roller lever and is articulated on another end of the roller lever on the rocker arm such that the roller lever pivots about the rocker arm axis;

(d) a switchable hydraulic locking device, by way of which the rocker arm and the roller lever are selectively:

(1) locked rigidly to one another, both following the at least one second cam, and (2) unlocked from one another, each following a respective one of the at least one first cam and the at least one second cam independently of one another, wherein the roller lever is connected to the rocker arm via a hinge, the hinge having an axis of rotation parallel to and spaced from the rocker arm axis.

2. The variable valve train according to claim 1, wherein the at least one lifting valve is a gas exchange valve of an internal combustion engine.

3. The variable valve train according to claim 1, wherein the at least one second cam includes two second cams respectively provided on first and second axial sides of the at least one first cam, and the roller lever extends from the camshaft-side end of the rocker arm and follows the cam contour of two second cams.

4. The variable valve train according to claim 1, wherein the at least one first cam includes two first cams respectively provided on first and second axial sides of the at least one second cam, and the camshaft-side end of the rocker arm extends from the roller lever and follows the cam contour of two first cams.

5. The variable valve train according to claim 1, wherein the rocker arm and the roller lever are braced against one another via at least one restoring spring in such a way that the roller of the rocker arm and the at least one roller of the roller lever are aligned with respect to one another in a base circle position.

6. The variable valve train according to claim 5, wherein the at least one restoring spring includes two restoring springs arranged on opposite sides of the rocker arm.

7. The variable valve train according to claim 1, wherein the switchable hydraulic locking device comprises a hydraulically actuable switching pin which is movable from a first position into a second position by way of loading with a predefined hydraulic pressure, the switching pin permitting a relative movement of the rocker arm and the roller lever with respect to one another about the rocker arm axis in the first position, and preventing a relative movement of the rocker arm and the roller lever about the rocker arm axis in the second position.

8. The variable valve train according to claim 7, further comprising a guide pin, a pin spring which is plugged onto the guide pin, and the switching pin which is screwed to the guide pin are arranged in the rocker arm in a sliding guide bore, and the switching pin loadable with the predefined hydraulic pressure via a pressure chamber fillable with oil in order to actuate a switching means, the locking device being configured in such a way that the switching pin, in a state in which the switching pin is not loaded with the predefined hydraulic pressure, is held by way of the pin spring which acts as a restoring spring and the guide pin, in the first position, and that the switching pin, in a state in which the switching pin is loaded with the predefined hydraulic pressure, is pressed into the second position, in which the switching pin protrudes out of the rocker arm towards the roller lever and moves into an aligned sliding guide seat of the roller lever.

9. The variable valve train according to claim 7, further comprising a guide pin, a pin spring which is plugged onto the guide pin, and the switching pin which is screwed to the guide pin are arranged in the rocker arm in a sliding guide bore, and the switching pin configured to be loaded with the predefined hydraulic pressure via a pressure chamber fillable with oil in order to actuate a switching means, the locking device being configured in such a way that the switching pin, in a state in which the switching pin is not loaded with the predefined hydraulic pressure, is held by way of the pin spring which acts as a restoring spring and the guide pin, in the second position, and that the switching pin, in a state in which the switching pin is loaded with the predefined hydraulic pressure, is pressed into the first position, in which the rocker arm moves in, with the result that the switching pin releases the aligned sliding guide seat of the roller lever.

10. The variable valve train according to claim 1, wherein the cam contour of the at least one first cam has a different cam elevation or a different phase position in comparison with the cam contour of the at least one second cam.

11. The variable valve train according to claim 1, wherein at the rocker arm's valve-side end, the rocker arm has a seat, in which a hydraulic valve play compensating element or a screw with an elephant foot formation is received.

12. The variable valve train according to claim 1, further comprising a bearing system of the rocker arm, having a rocker arm bearing block, on which the rocker arm axis is arranged, onto which the rocker arm is plugged pivotally by way of an associated bore and is held by means of an axial positional securing means, the axial positional securing means being a guide connection as engagement element/counterelement connection between the bearing block and the rocker arm, in which an engagement element which is oriented transversely with respect to an axial direction engages into an associated counterelement with axial flank support in a pivotally movable manner.

13. A motor vehicle, in particular a commercial motor vehicle, having a variable valve train for a lifting valve, which valve is moved periodically indirectly by way of a cam via a rocker arm between a closed and an open position, the valve train comprising (a) a camshaft, having at least one first cam and at least one second cam which are arranged offset in a longitudinal direction of the camshaft, the at least one first cam and the at least one second cam having different cam contours;

(b) a rocker arm, having a camshaft-side end and a valve-side end, and mounted pivotally about a rocker arm axis, the rocker arm is assigned to the at least one first cam via a roller on the camshaft-side end and is operatively connected to at least one lifting valve on the valve-side end;

(c) a roller lever assigned to the at least one second cam via at least one roller on a camshaft-side end of the roller lever and is articulated on another end of the roller lever on the rocker arm such that the roller lever pivots about the rocker arm axis;

(d) a switchable hydraulic locking device, by way of which the rocker arm and the roller lever are selectively:

(1) locked rigidly to one another, both following the at least one second cam, and (2) unlocked from one another, each following a respective one of the at least one first cam and the at least one second cam independently of one another, wherein the roller lever is connected to the rocker arm via a hinge, the hinge having an axis of rotation parallel to and spaced from the rocker arm axis.

14. A variable valve train for a lifting valve, which valve is moved periodically indirectly by way of a cam via a rocker arm between a closed and an open position, the valve train comprising:

(a) a camshaft, having at least one first cam and at least one second cam which are arranged offset in a longitudinal direction of the camshaft, the at least one first cam and the at least one second cam having different cam contours;

(b) a rocker arm, having a camshaft-side end and a valve-side end, and mounted pivotally about a rocker arm axis, the rocker arm is assigned to the at least one first cam via a roller on the camshaft-side end and is operatively connected to at least one lifting valve on the valve-side end;

(c) a roller lever assigned to the at least one second cam via at least one roller on a camshaft-side end of the roller lever and is articulated on another end of the roller lever on the rocker arm such that the roller lever pivots about the rocker arm axis;

(d) a switchable hydraulic locking device, by way of which the rocker arm and the roller lever are selectively:

(1) locked rigidly to one another, both following the at least one second cam, and (2) unlocked from one another, following a respective one of the at least one first cam and the at least one second cam independently of one another, wherein the rocker arm and the roller lever each include a pivot pin seat axially aligned with respect to one another so as to form a hinge with an inserted pivot pin, wherein the pivot pin has an axis parallel to and offset from the rocker axis.

* * * * *